US010689809B2

(12) United States Patent
Faucher et al.

(10) Patent No.: US 10,689,809 B2
(45) Date of Patent: Jun. 23, 2020

(54) PROCESS FOR MANUFACTURING PAPER AND BOARD

(71) Applicant: S.P.C.M. SA, Andrezieux Boutheon (FR)

(72) Inventors: Gatien Faucher, Andrezieux Boutheon (FR); Damien Fougerouse, Andrezieux Boutheon (FR); René Hund, Andrezieux Boutheon (FR)

(73) Assignee: S.P.C.M. SA, Andrezieux Boutheon (FR)

( * ) Notice: Subject to any disclaimer, the term of this patent is extended or adjusted under 35 U.S.C. 154(b) by 137 days.

(21) Appl. No.: 16/078,110

(22) PCT Filed: Jan. 25, 2017

(86) PCT No.: PCT/FR2017/050167
§ 371 (c)(1),
(2) Date: Aug. 21, 2018

(87) PCT Pub. No.: WO2017/149214
PCT Pub. Date: Sep. 8, 2017

(65) Prior Publication Data

US 2019/0048530 A1 Feb. 14, 2019

(30) Foreign Application Priority Data

Mar. 3, 2016 (FR) ..... 16 51794

(51) Int. Cl.

| | |
|---|---|
| ***D21H 21/10*** | (2006.01) |
| ***D21H 17/41*** | (2006.01) |
| ***D21H 21/18*** | (2006.01) |
| ***D21H 17/44*** | (2006.01) |
| ***D21H 17/45*** | (2006.01) |
| ***D21H 23/04*** | (2006.01) |

(52) U.S. Cl.
CPC ..... *D21H 21/10* (2013.01); *D21H 17/41* (2013.01); *D21H 17/44* (2013.01); *D21H 17/45* (2013.01); *D21H 17/455* (2013.01); *D21H 21/18* (2013.01); *D21H 23/04* (2013.01)

(58) Field of Classification Search
USPC ..... 162/164.6
See application file for complete search history.

(56) References Cited

U.S. PATENT DOCUMENTS

| | | | |
|---|---|---|---|
| 7,776,181 | B2 | 8/2010 | Mori et al. |
| 7,815,771 | B2 | 10/2010 | Faucher et al. |
| 8,778,139 | B2 | 7/2014 | Esser et al. |
| 8,926,797 | B2 | 1/2015 | Jehn-Rendu et al. |
| 2008/0004405 | A1 | 1/2008 | Mori et al. |
| 2009/0050282 | A1 | 2/2009 | Faucher et al. |
| 2009/0272506 | A1 | 11/2009 | Esser et al. |
| 2011/0155339 | A1 | 6/2011 | Brungardt et al. |
| 2012/0073773 | A1 | 3/2012 | Jehn-Rendu et al. |

FOREIGN PATENT DOCUMENTS

| | | | |
|---|---|---|---|
| EP | 0580529 | A1 | 1/1994 |
| EP | 0659780 | A2 | 6/1995 |
| EP | 0919578 | A1 | 6/1999 |
| EP | 1835074 | A1 | 9/2007 |
| WO | 98/24973 | A1 | 6/1998 |

OTHER PUBLICATIONS

International Search Report (and English translation) and Written Opinion of the International Searching Authority for PCT/FR2017/050167 dated May 4, 2017.

*Primary Examiner* — Mark Halpern
(74) *Attorney, Agent, or Firm* — Heslin Rothenberg Farley & Mesiti, P.C.

(57) ABSTRACT

The present invention relates to a process for manufacturing a sheet of paper and/or board from a fibrous suspension, according to which, before the formation of said sheet, added to the fibrous suspension, at one or more injection points, are at least two retention aids respectively:

(a) at least one water-soluble organic cationic polymer P1 having a cationicity greater than 2 $meq \cdot g^{-1}$, and (b) at least one water-soluble amphoteric polymer P2 of at least one anionic monomer and of at least one cationic monomer.

The polymer P2 is added to the fibrous suspension after dissolving, in aqueous solution, the polymer P2 previously obtained by one of the following polymerization techniques:

gel polymerization, suspension polymerization, inverse emulsion polymerization, dispersion polymerization.

The polymer P2 has a factor F>2, said factor F being defined by the formula: $F=UL^2 \times [(100-A)/(100-C)]$ with UL: Brookfield viscosity of the polymer P2 at 0.1% by weight in a 1M aqueous solution of NaCl, at 23° C., with a UL module and at 60 $rev \cdot min^{-1}$, A and C corresponding respectively to the molar percentages of the anionic and cationic monomers of the polymer P2.

20 Claims, 1 Drawing Sheet

PROCESS FOR MANUFACTURING PAPER AND BOARD

CROSS REFERENCE TO RELATED APPLICATIONS

This application is a national stage filing under section 371 of International Application No. PCT/FR2017/050167, filed on Jan. 25, 2017, and published on Sep. 8, 2017 as WO 2017/149214, which claims priority to French Application No. 1651794, filed on Mar. 3, 2016. The entire contents of WO 2017/149214 are hereby incorporated herein by reference.

FIELD OF THE INVENTION

The invention relates to a process for manufacturing paper and board having improved total retention, filler retention and dewatering properties without negatively affecting the mechanical characteristics of the paper/board. More precisely, the aim of the invention is a manufacturing method implementing at least two retention and dewatering aids, that are respectively:

at least one water-soluble cationic polymer, and at least one water-soluble amphoteric polymer.

A further subject of the invention is the papers and boards obtained by this method.

DESCRIPTION OF THE PRIOR ART

The paper industry is continually seeking to optimize the manufacturing process thereof, more particularly in terms of yield, productivity, cost reduction and quality of the finished product.

Numerous documents describe processes for manufacturing papers and boards with improved retention properties.

Document EP 0 580 529 describes a process for manufacturing papers and boards having improved retention properties wherein a terpolymer based on linear amphoteric acrylamide, in the form of a powder in solution, and bentonite are added to the fibrous suspension.

The implementation of bentonite has an undeniable inconvenience from the point of view of the papermaker. Indeed, industrial units for preparing bentonite represent a significant investment as well as extensive maintenance for paper mills. Bentonite may also have compaction problems due to the ambient humidity around the paper machine, which disrupts the preparation of the bentonite dispersion itself.

Document U.S. Pat. No. 7,776,181 describes a papermaking process which corresponds to the addition of a composition, consisting of a mixture of a water-soluble cationic polymer and a water-soluble amphoteric polymer, both in the form of a powder, enabling improvement of retention and sheet formation.

The cationic polymer described in this document preferably has a cationicity of less than 4 $meq \cdot g^{-1}$ and the amphoteric polymer has a molar ratio of cationic monomers to anionic monomers of between 5 and 15.

From an industrial point of view, the mixing of the two powders is very complex and costly in order to obtain a perfectly homogeneous mixture. Furthermore, there is naturally a certain segregation of powder particles depending on the size and shape thereof, notably due to vibrations during handling and transportation of the bags of powder.

The integrity of the composition of such a product is therefore very difficult to guarantee during the use thereof in the paper mill, and may therefore cause fluctuations to a greater or lesser extent on the operation of the paper machine.

Document U.S. Pat. No. 7,815,771 describes a process for manufacturing paper and board comprising the addition to the cellulosic suspension of three components:

at least one main retention aid composed of a cationic (co)polymer preferably having an intrinsic viscosity greater than 2 $dL \cdot g^{-1}$, at least one secondary retention aid selected from the group: silica derivatives, anionic or amphoteric organic polymers, and at least one tertiary retention aid composed of a crosslinked anionic polymer, with a particle size of greater than or equal to 1 micron and an intrinsic viscosity of less than 3 $dL \cdot g^{-1}$.

In this document, the use of the three components is crucial. Firstly, the main aid is preferably a cationic polyacrylamide used conventionally as a retention aid, and secondly, the secondary and tertiary retention aids are preferably anionic, the tertiary aid being an anionic crosslinked polymer in the form of a conventional emulsion.

None of the previous documents, aiming to improve retention properties, claims the maintenance of the mechanical properties of the paper as the retention performances, and more particularly the filler retention performance, increase.

Furthermore, there are documents describing papermaking processes claiming an improvement of the dry strength properties of paper.

Document U.S. Pat. No. 8,926,797 describes a process for manufacturing paper and board having high dry strength by adding to the fibrous suspension:

a trivalent cationic salt, a water-soluble cationic polymer of the polyvinylamine or polyethyleneimine type, a water-soluble amphoteric polymer.

The use of a trivalent salt as a first component is described as being imperative in this combination. This leads to a lowering of the pH of the fibrous suspension on the machine, which will then be operating under acidic conditions. The use of calcium carbonate type fillers is prohibited in such cases. Indeed, carbonates are soluble in acid pH and are therefore lost in the white water.

To overcome this phenomenon, and to be able to manufacture papers and boards with significant filler levels, operating machines in neutral or pseudo-alkaline conditions is recommended.

From references (notably EP 0 659 780 and EP 0 919 578) cited in document U.S. Pat. No. 8,926,797, amphoteric polymers used are typically polyacrylamides containing a specific monomer of the sodium methallyl sulfonate type. These products are well known to a person skilled in the art, being in liquid form with a Brookfield viscosity in the order of 5000 cps (Module LV3, 12 rev $min^{-1}$, 23° C.) at 20% active material. This type of product therefore has a Brookfield viscosity very much lower than 2 cps in a 1M NaCl solution (Module UL, 60 $rev \cdot min^{-1}$, 23° C.).

A beneficial effect is observed on the dry strength performances of the paper when the operator adjusts the filler levels in the sheets such as to keep them constant. Nevertheless, this document makes no claim of a concomitant improvement in the filler retention.

Document US 2011/0155339 describes a process for manufacturing paper and board, having improved dry strength properties, by combining, in the wet end of the machine:

a solution of polyvinylamine type polymer, and having a molecular weight of between 75,000 and 750,000 daltons, and a solution of cationic or amphoteric polyacrylamide, having a molecular weight of between 75,000 and 1,500,000 daltons, wherein the sum of the ionic monomers is greater than 5 mol %.

The amphoteric polyacrylamides shown in this document have been obtained by aqueous solution polymerization. They are therefore in the form of a liquid phase with a molecular weight lower than 1.5 million daltons and therefore a viscosity very much lower than 2 cps (at 0.1% in a 1M NaCl solution with Brookfield Module UL, speed 60 rpm, measured at 23° C.).

The dry strength performances are effectively obtained but without actual improvement in the retention or in the filler retention.

Document U.S. Pat. No. 8,778,139 refers to a papermaking process wherein at least one filler dispersion, at least partially "coated" by an amphoteric copolymer, is added to the fibrous suspension in the presence of at least one cationic or amphoteric polymer not having any quaternized amino-alcohol ester functions.

A person skilled in the art would understand upon reading this document that it is about a pre-treatment of the dispersion of fillers with an amphoteric polymer (an amphoteric polyvinylamine being notably exemplified), then the addition of a cationic polyvinylamine within the pulp, added to the dispersion of pretreated fillers, with the aim of improving the mechanical characteristics of the paper. The filler content obtained in the sheets is adjusted by the operator.

Pre-treatment of a dispersion of fillers presents numerous complications in terms of implementation, and the risk to the papermaker is not insignificant. The most probable major risk is destabilization (caking) of the dispersion within the machine feed line. The most disastrous consequence is the pure and simple stoppage of the paper machine.

Furthermore, the process combines two products originating from N-vinylformamide chemistry, which is much more costly than the chemistry of acrylamide and acrylate.

These last three references report improvements in the mechanical properties of the paper, but do not show any improvement in retention or filler retention performances.

Filler retention consists of specifically retaining fillers (small, mineral species having little affinity for cellulose).

Significant improvement in filler retention leads to clarification of the white waters by holding fillers in the paper sheet as well as increasing the grammage thereof.

This also gives the possibility of substituting some of the fibers (the most costly species in the paper composition) with fillers (lower cost) in order to reduce paper manufacturing costs.

Furthermore, the optical properties of the final paper (opacity, whiteness, for example) will be improved, which will also result in better printability.

The fact of significantly increasing the filler content in the paper sheet will also have a beneficial impact on the drying capabilities of the sheet and therefore on the energy/steam consumed, which may potentially increase machine speeds. This means improving dynamic draining, or dewatering under vacuum, measured by DDA (Dynamic Drainage Analyzer).

Consequently, all of these elements contribute to improved productivity and machine operation, which implies an overall cost reduction.

In contrast, if the filler retention is low, white waters may become excessively loaded, with risks of deposits or foaming within the short circuit. These deposits or foams of various natures may cause machine breakdowns. Production stoppages, as well as the maintenance associated with complete cleaning of the installation, reduce the productivity of the machine further and widely contribute to increasing manufacturing costs.

This is why, for decades, paper makers have been attempting to increase the filler content \within the paper thereof. In this very competitive industry, this is a major issue and the survival of certain paper manufacturers is at stake. The issues are considerable when this objective of obtaining a high filler retention cannot be fulfilled.

Nevertheless, the person skilled in the art is confronted with a dual problem. Indeed, the increase in the quantity of fillers in the fibrous web leads to:

"blocking the pores" between the fibers and therefore "closing" the sheet, which has a negative impact on dewatering performance, reducing the number of inter-fiber hydrogen bonds, which causes a degradation of the mechanical characteristics of the paper/board obtained.

An antagonistic effect is observed between, on the one hand, filler retention and dewatering, and on the other hand, between filler retention and the physical characteristics of the paper/board.

The present invention enables this problem to be resolved.

DISCLOSURE OF THE INVENTION

As we have previously seen in the prior art, paper and board manufacturing processes with improved retention properties fail to show the impact thereof on the mechanical characteristics of the sheets obtained.

Furthermore, some papermaking processes have been described enabling an improvement in mechanical properties (dry strength particularly), which do not show significant and simultaneous improvement of retention, filler retention or dewatering.

The aim of the present invention is therefore to propose a process for the manufacturing of a sheet of paper and/or board from a fibrous suspension, said paper and/or board having improved total retention, filler retention and dewatering properties without affecting the mechanical characteristics thereof. Indeed, surprisingly, the implementation of at least two retention and dewatering aids enables this objective to be reached. In this process, before the formation of said sheet of paper and/or board, added to the fibrous suspension, at one or more injection points, are at least two retention aids, respectively:

(a) at least one water-soluble organic cationic polymer P1 having a cationicity greater than 2 $meq \cdot g^{-1}$, and (b) at least one water-soluble amphoteric polymer P2, characterized in that polymer P2 is added to the fibrous suspension after dissolving, in aqueous solution, the polymer P2 previously obtained by one of the following polymerization techniques:

gel polymerization, suspension polymerization, inverse emulsion polymerization, dispersion polymerization, and in that polymer P2 has a factor F>2, said factor F defined by the formula: $F=UL^2\times[(100-A)/(100-C)]$ with UL: Brookfield viscosity of the polymer P2 at 0.1% by weight in a 1M aqueous solution of NaCl, at 23° C., with a UL module and at 60 $rev \cdot min^{-1}$.

A and C corresponding respectively to the molar percentages of the anionic and cationic monomers of the polymer P2.

In other terms, the factor F is the product of the Brookfield viscosity of the amphoteric polymer squared and of the molar ratio of all of the monomers thereof other than anionic over all of the monomers thereof other than cationic.

In the description which follows and in the claims, all the polymer dosages expressed in $g \cdot t^{-1}$ are given in weight of active polymer per metric ton of dry paper and/or board.

Secondly, a water-soluble compound corresponds to a compound soluble in water under normal conditions of use in a process for manufacturing paper and/or board.

Retention aids are introduced into the fibrous suspension at one or more injection points, a person skilled in the art knowing to optimize the injection order of these aids.

As already indicated, polymer P2 is introduced in the form of an aqueous solution which is prepared by dissolving polymer P2 in water.

Fibrous suspension means the thick pulp or dilute pulp which are based on water and cellulosic fibers. The thick pulp (Thick Stock), having a dry matter concentration by mass of 1%, even greater than 3%, is upstream of the mixing pump (fan-pump). The dilute pulp (Thin Stock), having a dry matter concentration of generally less than 1%, is situated downstream of the mixing pump.

The retention aid P1 is preferably introduced into the fibrous suspension at a rate of 100 to 1500 $g \cdot t^{-1}$ and more preferably from 250 to 750 $g \cdot t^{-1}$ of dry paper and/or board.

Furthermore, the retention aid P2 is preferably introduced into the fibrous suspension at a rate of 100 to 1500 $g \cdot t^{-1}$ and more preferably from 250 to 750 $g \cdot t^{-1}$ of dry paper and/or board.

Preferably, the water-soluble organic cationic polymer P1 with a cationicity greater than 2 $meq \cdot g^{-1}$ is selected from:

(i) the polyvinylamine type polymers (including homopolymers and copolymers) and/or (ii) polyethyleneimines, and/or, (iii) polyamines (including homopolymers and copolymers), and/or (iv) poly(diallyldimethylammonium chloride) (poly (DADMAC)) (including homopolymers and copolymers), and/or, (v) poly(amidoamine-epihalohydrin) (PAE).

The polyvinylamines (including homopolymers and copolymers) corresponding to point (i) above may be obtained by:

(i-a) degradation reaction known as Hofmann, on a (co) polymer comprising at least one non-ionic monomer selected from the group comprising in a non-limiting way, acrylamide, methacrylamide, N,N-dimethylacrylamide, t-butylacrylamide, octylacrylamide, and/or, (i-b) (co)polymerization reaction of at least one monomer of formula (I):

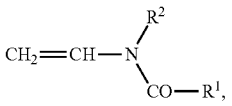

(I)

where $R^1$ and $R^2$ are, independently, a hydrogen atom or an alkyl chain with 1 to 6 carbons, followed by partial or complete elimination of the —CO—$R^1$ group, for example by hydrolysis, so as to form amine functions.

Examples of monomers of formula (I) include, notably, N-vinylformamide, N-vinyl-N-methylformamide, N-vinylacetamide, N-vinyl-N-methylacetamide, N-vinyl-N-ethylacetamide, N-vinyl-propianamide, and N-vinyl-N-methylpropianamide and N-vinylbutyramide. The preferred monomer being N-vinylformamide.

These monomers of formula (I) may be used alone or copolymerized with other monomers in the wider sense. By way of example, other monomers may be acrylamide derivatives, acrylic acid derivatives and the salts thereof, cationic monomers, zwitterionic monomers or hydrophobic monomers.

Polymers corresponding to point (i-b) above are well known to a person skilled in the art and are widely described, for example in documents DE 35 06 832, DE 10 2004 056 551, EP 0 438 744, EP 0 377 313, and WO 2006/075115.

Preferably, polymer P1 results from the degradation reaction known as Hofmann, in aqueous solution, in the presence of an alkaline earth and/or alkali hydroxide and an alkaline earth and/or alkali hypo-halide, on a (co)polymer based on at least:

a non-ionic monomer selected from the group comprising acrylamide, methacrylamide, N,N-dimethylacrylamide, t-butylacrylamide, octylacrylamide, optionally another monomer containing at least one unsaturated bond.

Products of this type are well known to a person skilled in the art and are widely described, for example in documents WO 2006/075115, WO 2008/113934, WO 2009/13423, WO 2008/107620, WO 2010/61082, WO 2011/15783, and WO 2014/09621.

According to another preference, polymer P1 is a fully or partially hydrolyzed N-vinylformamide (co)polymer.

The ethylenimine polymers corresponding to point (ii) above include notably all polymers obtained by the polymerization of ethylenimine in the presence of acids, Lewis acids or haloalkanes (see documents U.S. Pat. Nos. 2,182,306 and 3,203,910). These polymers may, if necessary, be post-crosslinked (see WO 97/25367).

Polyethylenimines are widely described, for example in documents EP 0 411400, DE 24 34 816 and U.S. Pat. No. 4,066,494.

For example, polyethylenimines may be selected from the non-limiting group: ethylenimine homopolymers, reaction of a polyethylenimine and a crosslinking aid, ethylenimine grafted onto a polyamidoamine post-crosslinked, amidation of a polyethylenimine by a carboxylic acid, Michael reaction on a polyethylenimine, phosphonomethylated polyethylenimine, carboxylated polyethylenimine, and alkoxylated polyethylenimine.

The polyamine type polymers corresponding to point (iii) above comprise products from the reaction of a secondary amine with a difunctional epoxide compound.

Secondary amines may be selected from dimethylamine, diethylamine, dipropylamine and secondary amines containing various alkyl groups with 1 to 3 carbon atoms.

The difunctional epoxide compound is advantageously epibromohydrin or epichlorhydrin.

The poly(DADMAC)-type polymers corresponding to point (iv) above are homopolymers or copolymers of diallyldimethylammonium chloride.

The PAE-type polymers corresponding to point (v) above are poly(amidoamine-epihalohydrin).

These poly(amidoamine-epihalohydrin) are advantageously obtained by reacting an aliphatic polyamine, an aliphatic polycarboxylic acid and an epihalohydrin. An example of PAE is the product of reacting adipic acid with ethylene triamine and epichlorhydrin.

Preferably the polymer P1 is a polyamine.

According to another preferred embodiment, polymer P1 is a poly(DADMAC).

Finally, in a final preferred embodiment, polymer P1 is a PAE.

Polymer P1 has a cationic charge density greater than 2 $meq \cdot g^{-1}$ but preferably this charge density is greater than 4 $meq \cdot g^{-1}$.

The water-soluble amphoteric polymer P2, with a factor F>2, is preferably a polymer of:

a/ at least one cationic monomer selected from the group comprising dimethylaminoethyl acrylate (ADAME) quaternized or salified, and/or dimethylaminoethyl methacrylate (MADAME) quaternized or salified, and/or dimethyldiallylammonium chloride (DADMAC), and/or acrylamido propyltrimethyl ammonium chloride (APTAC), and/or methacrylamido propyltrimethyl ammonium chloride (MAPTAC), and/or fully or partially hydrolyzed N-vinyl formamide, b/ at least one anionic monomer c/ and/or at least one non-ionic monomer, d/ optionally at least one monomer with a zwitterionic nature, e/ optionally at least one monomer with a hydrophobic nature, f/ optionally at least one monomer containing at least two unsaturated bonds.

The monomers from group b/ being for example (meth) acrylic acid or 2-acrylamido-2-propane sulfonic acid (AMPS), vinylsulfonic acid or even vinylphosphonic acid, and the salts thereof.

The monomers of group c/ may be selected from acrylamide, methacrylamide and non-ionic derivatives thereof, N-vinyl acetamide, N-vinyl formamide, N-vinylpyrrolidone, vinyl acetate.

An example of a zwitterionic monomer of group d/ is 3-[[2-(methacryloyloxy)ethyl]dimethylammonio]propionate (CBMA).

Some examples of hydrophobic monomers of group e/ are the hydrophobic derivatives of acrylamide such as N-acrylamidopropyl-N,N-dimethyl-N-dodecyl ammonium chloride or bromide (DMAPA Cl or Br(C12)) and N-acrylamidopropyl-N,N-dimethyl-N-octadecyl ammonium chloride or bromide (DMAPA C1 or Br(C18)), styrene, alkyl-acrylates, alkyl-methacrylates, aryl-acrylates, aryl-methacrylates.

Some examples of monomers of group f may be methylene bisacrylamide (MBA), triallylamine, ethylene glycol diacrylate.

According to the invention, polymers P2 are obtained by one of the following techniques well known to a person skilled in the art:

gel polymerization leading to a polymer powder, suspension polymerization leading to polymer microbeads, inverse emulsion polymerization leading to microgels of polymer in suspension in a non-aqueous solvent, or dispersion polymerization leading to a polymer in solid form in suspension in an aqueous saline solution.

It is to be noted that in documents U.S. Pat. No. 8,926,797 and US 2011/0155339 the amphoteric polymers described are:

firstly, exclusively obtained by solution polymerization, secondly, used with the aim of improving the mechanical properties of the paper, and not the retention, filler retention or dewatering.

Prior to the addition of polymer P2 into the fibrous suspension, this is dissolved in water.

Polymer P2 preferably has a Brookfield viscosity greater than 2 cps and even more preferably greater than 2.4 cps (UL module, 0.1% by weight, 1M NaCl, 60 $rev \cdot min^{-1}$, 23° C.).

The mass ratio between polymer P1 and polymer P2 introduced into the fibrous suspension is preferably between 1/10 and 10/1, and more preferably 1/5 and 5/1.

Finally, a tertiary aid may be added to the fibrous suspension. This tertiary retention aid is selected from anionic polymers in the broad sense, which may therefore be (without being limited) linear, branched, crosslinked, hydrophobic, associative and/or inorganic microparticles (such as bentonite, colloidal silica).

This tertiary retention aid is preferably introduced into the fibrous suspension at a rate of 20 to 2500 $g \cdot t^{-1}$ and more preferably between 25 and 2000 $g \cdot t^{-1}$ of dry paper and/or board.

It should be noted that the order of introducing the two (P1 and P2), or optionally three, retention aids, as a mixture or not, is to be optimized by a person skilled in the art on a case by case basis, depending on each papermaking system.

The figures and following examples illustrate the invention without however limiting the scope thereof.

EXAMPLE EMBODIMENTS OF THE INVENTION

Figure 1:
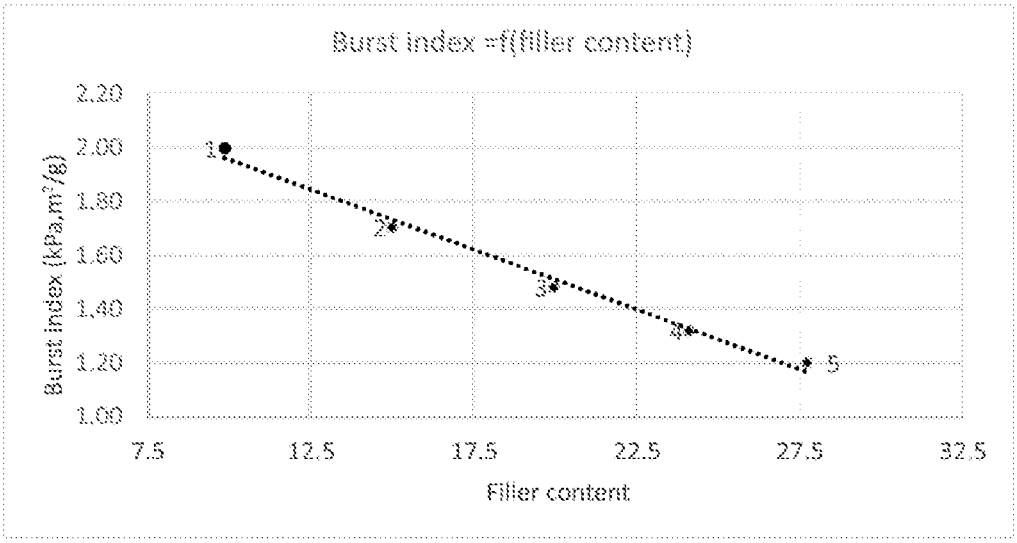
FIG. 1 shows the burst index of a sheet of paper as a function of filler content.

Products Tested in the Examples:

In the following list, products of type A are anionic, type B amphoteric and type C cationic. These 3 classes of products conform to the retention aids described in the method of the invention.

Products of type X are salts of trivalent cations, as described in the processes in the prior art.

Products of type Z are amphoteric but do not have the characteristics of the polymers P2 described in the method of the invention.

A1: Anionic polymer 40 mol %, in the form of a water-in-oil emulsion with a Brookfield viscosity of 2.5 cps (Module UL, 0.1%, NaCl 1M, 60 $rev \cdot min^{-1}$, 23° C.

A2: Bentonite sold under the name Opazil AOG by Süd Chemie.

B1: Water-soluble amphoteric polymer, in the form of a powder, with a Brookfield viscosity of 2.7 cps (Module UL, 0.1%, NaCl 1M, 60 $rev \cdot min^{-1}$, 23° C.) and a factor F of 7.78.

B2: Water-soluble amphoteric polymer, in the form of a powder, with a Brookfield viscosity of 2.8 cps (Module UL, 0.1%, NaCl 1M, 60 $rev \cdot min^{-1}$, 23° C.) and a factor F of 8.88.

B3: Water-soluble amphoteric polymer, in the form of microbeads, with a Brookfield viscosity of 2.6 cps (Module UL, 0.1%, NaCl 1M, 60 rev·min$^{-1}$, 23° C.) and a factor F of 7.23.

B4: Water-soluble amphoteric polymer, in the form of a water-in-water dispersion, with a Brookfield viscosity of 2.0 cps (Module UL, 0.1%, NaCl 1M, 60 rev·min$^{-1}$, 23° C.) and a factor F of 3.72.

C1: Cationic polymer obtained by Hofmann degradation reaction, Brookfield viscosity of 100 cps (Module LV1, 30 rev·min$^{-1}$, 23° C.) and active material 10.5%.

C2: Cationic polymer obtained by partial hydrolysis of poly(vinylformamide). The hydrolysis rate is 30 mol %, molecular weight 350,000 daltons and active material 16.4%. This is Xelorex® RS 1100 from BASF.

C3: Cationic polymer obtained by partial hydrolysis of poly(vinylformamide). The hydrolysis rate is 50 mol %, molecular weight 300,000 daltons and active material 13.4%. This is Hercobond® 6350 from Solenis.

C4: Cationic polymer of polyethylenimine type with molecular weight of 1,000,000 daltons and active material 21%. This is Polymin® SK from BASF.

C5: Polyamine with Brookfield viscosity 5,000 cps (Module LV3, 12 rev·min$^{-1}$, 23° C.) at 50% active material.

C6: Poly(DADMAC) with Brookfield viscosity 2,000 cps (Module LV3, 12 rev·min$^{-1}$, 23° C.) at 40% active material.

C7: PAE with Brookfield viscosity 50 cps (Module LV1, 60 rev·min$^{-1}$, 23° C.) at 12.5% active material.

X1: Aluminum polychloride (PAC) containing 18% alumina ($Al_2O_3$)

X2: Technical aluminum sulfate (Alum) in powder form ($Al_2(SO_4)_3.14H_2O$)

Z1: Amphoteric polyacrylamide, in liquid form with Brookfield viscosity of 3,000 cps (Module LV3, 12 rev·min$^{-1}$, 23° C.) at 19.8%, with a factor F of 1.60. Product used in the prior art U.S. Pat. No. 8,926,797 under the name Harmide® RB217 from Harima.

Z2: Amphoteric polyacrylamide, in liquid form with Brookfield viscosity of 7,000 cps (Module LV3, 12 rev·min$^{-1}$, 23° C.) at 20.1%, with a factor F of 1.42. Product used in the prior art US 2011/0155339 under the name Hercobond® 1205 from Solenis.

Procedures Used in the Examples:

a) The Various Types of Pulp Used

Virgin fiber pulp (used in examples 1, 2, 3, 4, 5):

Wet pulp is obtained by pulping dry pulp in order to obtain a final aqueous concentration of 1% by mass. This is a pulp with neutral pH composed of 90% long virgin bleached fibers, 10% short virgin bleached fibers, and 30% additional GCC (Hydrocal® 55 from Omya)

Recycled fiber pulp (used in example 6):

Wet pulp is obtained by pulping dry pulp in order to obtain a final aqueous concentration of 1% by mass. This is a pulp with neutral pH composed of 100% recycled board fibers.

b) Evaluation of the Total Retention and Filler Retention

The various results are obtained using a "Britt Jar" type container, with a stirring speed of 1000 rpm.

The sequence of adding the various retention aids being as follows:

T=0 s: Stirring 500 ml of pulp at 0.5% by mass

T=10 s: Addition of cationic retention aid

T=20 s: Addition of amphoteric retention aid

T=25 s: Optional addition of tertiary retention aid

T=30 s: Removal of the first 20 ml corresponding to the dead volume under the wire, then recovery of 100 mL white waters.

First pass retention as a percentage (% FPR: First Pass Retention), corresponding to the total retention being calculated according to the following formula:

$$\% \text{ FPR}=(C_{HB}-C_{WW})/C_{HB}*100$$

First pass ash retention as a percentage (% FPAR: being calculated according to the following formula:

$$\% \text{ FPAR}=(A_{HB}-A_{WW})/A_{HB}*100$$

Where:

$C_{HB}$: Consistency of the headbox $C_{WW}$: Consistency of the white water $A_{HB}$: Consistency of the headbox ash $A_{WW}$: Consistency of the white water ash c) Evaluation of the Gravity Dewatering Performance Using Canadian Standard Freeness (CSF)

In a beaker, the pulp is treated, subjected to a stirring speed of 1000 rpm. The sequence of adding the various retention aids being as follows:

T=0 s: Stirring 500 ml of pulp at 0.6% by mass

T=10 s: Addition of cationic retention aid

T=20 s: Addition of amphoteric retention aid

T=25 s: Optional addition of tertiary retention aid

T=30 s: Stirring stopped and addition of the quantity of water necessary to obtain 1 liter.

This liter of pulp is transferred into the Canadian Standard Freeness Tester and the TAPPI T227om-99 procedure is performed.

The volume, expressed in mL, collected by the lateral tube gives a measure of the gravitational dewatering. The higher this value, the better the gravitational dewatering.

d) Evaluation of the DDA Dewatering Performance

The DDA (Dynamic Drainage Analyzer) makes it possible to automatically determine the amount of time (in seconds) necessary to drain a fibrous suspension under vacuum. The polymers are added to the wet pulp (0.6 liter of pulp at 1.0% by mass) in the DDA cylinder under stirring at 1000 rpm:

T=0 s: pulp stirring

T=10 s: addition of cationic retention aid

T=20 s: Addition of amphoteric retention aid

T=25 s: Optional addition of tertiary retention aid

T=30 s: stirring stopped and dewatering under vacuum at 200 mBar for 70 s

The pressure under the wire is recorded as a function of time. When all the water is evacuated from the fibrous web, air passes through it causing a break in the slope of the curve showing the pressure under the wire as a function of time. The time, expressed in seconds, at this break in the slope, corresponds to the dewatering time. The lower the time, the better the dewatering under vacuum.

e) Dry Strength Resistance (DSR) Performance, Grammage 90 g·m$^{-2}$

The quantity of pulp necessary is sampled so as to obtain a sheet with a grammage of 90 g·m$^{-2}$.

The wet pulp is introduced into the dynamic handsheet former and is maintained under stirring. The various components of the system are injected into this pulp according to the predefined sequence. Generally, a contact time of 30 to 45 seconds between each addition of polymer is maintained.

Paper handsheets are made with an automatic handsheet former: a blotter and the forming wire are placed in the jar of the dynamic handsheet former before starting rotation of the jar at 1000 rev·min$^{-1}$ and constructing the water wall. The treated pulp is distributed over the water wall to form the fibrous sheet on the forming wire.

Once the water has been drained, the fibrous sheet is collected, pressed under a press delivering 4 bars, then dried at 117° C. The sheet obtained is conditioned overnight in a controlled temperature and humidity room (50% relative humidity and 23° C.). The dry strength properties of all the sheets obtained by this method are then measured.

The bursting is measured with a Messmer Buchel M 405 bursting meter according to standard TAPPI T403 om-02. The result is expressed in kPa. The burst index, expressed in kPa·m$^2$/g, is determined by dividing this value by the grammage of the sheet tested.

The breaking length is measured in the machine direction with a Testometric AX traction device according to standard TAPPI T494 om-01 The result is expressed in km.

To illustrate the fact that the increase in filler levels in the sheet, without any treatment, is detrimental to the mechanical properties of the paper obtained, a series of sheets has been produced using a pulp at neutral pH, composed of 90% by mass long virgin bleached fibers and 10% by mass of short virgin bleached fibers, with different quantities of additional fillers.

The levels of fillers contained in these sheets as well as the mechanical properties (burst index and breaking length in the machine direction) have been measured.

Figure 2:
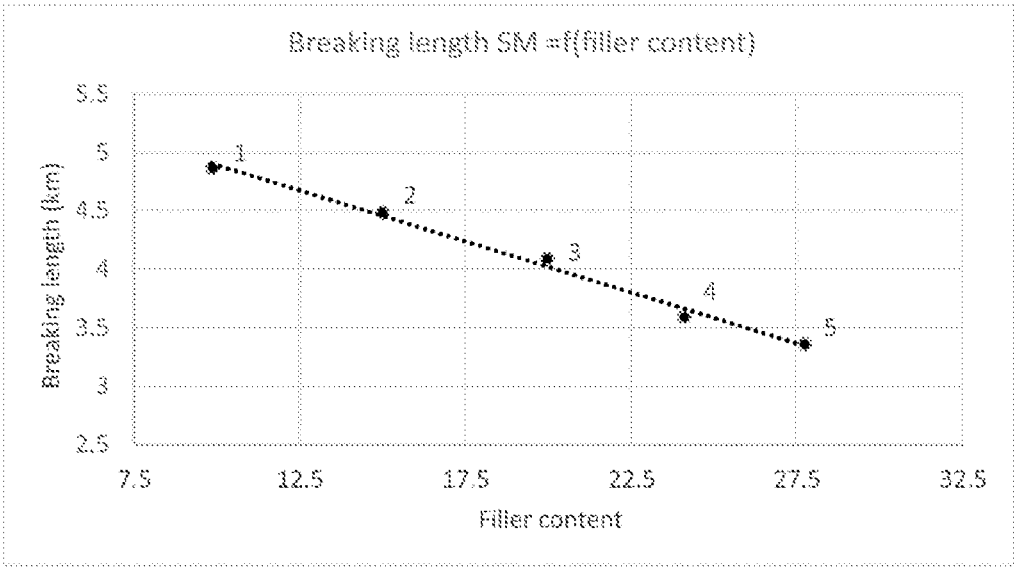
FIG. 2 shows the breaking length of a sheet of paper as a function of filler content.

By plotting the mechanical performance as a function of the filler levels in the sheet, the graphs in FIGS. 1 and 2 are obtained.

From these graphs, it is perfectly clear that the increase in filler levels in a sheet has a detrimental effect, by strongly decreasing the mechanical properties of the sheet itself.

Example 1: Combination, from the Invention, Between a Cationic Product and an Amphoteric Product (on a Virgin Fiber Pulp)

TABLE 1

Properties obtained in the presence (invention) or not (blank) of a cationic product and an amphoteric product

| Products | Dosage (kg/t) | FPR (%) | FPAR (%) | DDA (s) | Burst index (kPa · m$^2$/g) | Breaking length (km) | Filler content (% mass) |
|---|---|---|---|---|---|---|---|
| Blank | 0 | 72.6 | 8.6 | 33.6 | 1.48 | 4.09 | 20 |
| C1 | 0.25 | 81.5 | 40.3 | 20.6 | 1.58 | 4.23 | 22.6 |
| B1 | 0.25 | | | | | | |
| C1 | 0.5 | 86.2 | 58.2 | 13.8 | 1.57 | 4.33 | 23.9 |
| B1 | 0.5 | | | | | | |
| C1 | 0.75 | 87.9 | 66.7 | 11.9 | 1.69 | 4.44 | 24.9 |
| B1 | 0.75 | | | | | | |
| C1 | 1 | 89.2 | 69.0 | 11.3 | 1.89 | 4.62 | 25.2 |
| B1 | 1 | | | | | | |
| C1 | 1.5 | 90.7 | 71.1 | 11.1 | 19.5 | 4.72 | 25.4 |
| B1 | 1.5 | | | | | | |

The "blank" corresponds to a test without additive.

By combining a Hofmann degradation product with an amphoteric product in the form of a powder, as described in the invention, at various dosages, it can be seen from Table 1 that it is possible, on the one hand, to drastically improve the retention, filler retention and dewatering performances, and on the other hand, to increase the level of filler in the sheet without negatively affecting the mechanical characteristics thereof (burst index and breaking length).

It is also observed that there are no inverse effects by increasing the dosages of C1 and B2 and that all properties improve with the dosages applied, including the physical characteristics of the paper.

Clearly, the formation of the sheet is not affected.

Example 2: Combination, from the Invention, Between a Cationic Product, an Amphoteric Product and an Anionic Product (on a Virgin Fiber Pulp)

TABLE 2

Properties obtained in the presence (invention) or not (blank) of a cationic product, an amphoteric product and an anionic product

| Products | Dosage (kg/t) | FPR (%) | FPAR (%) | DDA (s) | Burst index (kPa · $m^2$/g) | Breaking length (km) | Filler content (%) |
|---|---|---|---|---|---|---|---|
| Blank | 0 | 72.6 | 8.6 | 33.6 | 1.48 | 4.09 | 20 |
| C1 | 0.25 | 87.5 | 64.6 | 11.9 | 1.5 | 4.01 | 23.8 |
| B1 | 0.25 | | | | | | |
| A1 | 0.15 | | | | | | |
| C1 | 0.5 | 90.5 | 72.3 | 9.4 | 1.51 | 4.13 | 25.2 |
| B1 | 0.5 | | | | | | |
| A1 | 0.15 | | | | | | |
| C1 | 0.75 | 92.2 | 78.3 | 7.7 | 1.61 | 4.21 | 26.2 |
| B1 | 0.75 | | | | | | |
| A1 | 0.15 | | | | | | |
| C1 | 1 | 92.6 | 81.1 | 7.7 | 1.73 | 4.37 | 26.8 |
| B1 | 1 | | | | | | |
| A1 | 0.15 | | | | | | |
| C1 | 0.5 | 89.7 | 71.7 | 8.5 | 1.50 | 4.10 | 25.1 |
| B1 | 0.5 | | | | | | |
| A2 | 1.5 | | | | | | |

The "blank" corresponds to a test without additive.

With the three-component system previously described in the invention, it can be seen in Table 2 behavior identical to Example 1. Furthermore, the retention, filler retention and dewatering performances are even better with the use of the tertiary aid, notably at low dosage.

The filler levels in the sheet are higher, without however compromising the mechanical properties.

The fact that the mechanical characteristics of the sheet are not negatively impacted at the highest dosages clearly shows that the formation of the sheet has not been affected.

The use of bentonite as tertiary anionic retention aid enables high retention, filler retention and dewatering performance levels to be obtained, comparable to an anionic organic polymer.

Example 3: Variation of the Cationic Component on the Retention, Filler Retention and Dewatering Under Vacuum Performances (on a Virgin Fiber Pulp)

TABLE 3

Properties obtained in the presence (invention and counter-examples) or (not) of at least one cationic product and an amphoteric product

| Products | Dosage (kg/t) | FPR (%) | FPAR (%) | DDA (s) | |
|---|---|---|---|---|---|
| Blank | 0 | 72.0 | 4.9 | 34.7 | CE |
| B1 | 0.5 | 79.6 | 29.8 | 17.7 | |
| C1 | 0.5 | 87.5 | 63.2 | 16.2 | |
| B1 | 0.5 | | | | |
| C2 | 0.5 | 87.9 | 62.8 | 16.6 | |
| B1 | 0.5 | | | | |
| C3 | 0.5 | 88.5 | 64.8 | 15.2 | |
| B1 | 0.5 | | | | |
| C4 | 0.5 | 86.5 | 61.8 | 16.6 | |
| B1 | 0.5 | | | | |
| C5 | 0.5 | 86.0 | 57.3 | 17.7 | |
| B1 | 0.5 | | | | |
| C6 | 0.5 | 84.4 | 51.4 | 18.4 | |
| B1 | 0.5 | | | | |
| C7 | 0.5 | 84.3 | 50.6 | 21 | |
| B1 | 0.5 | | | | |
| X1 | 0.5 | 87.7 | 63.4 | 16.1 | CE |
| C1 | 0.5 | | | | |
| B1 | 0.5 | | | | |
| X1 | 0.5 | 79.7 | 30.0 | 17.5 | CE |
| B1 | 0.5 | | | | |

CE: counter-example, combination non-compliant with the method of the invention.
The "blank" corresponds to a test without additive.

From the results in Table 3, it can be seen that the combination, described in the invention, of the various cationic products of type Ci with the amphoteric product B1 presents a real synergy and enables the retention, filler retention and dewatering properties to be improved in a surprising way.

The best performances are nevertheless obtained by combining a cationic polymer containing primary amine functions with an amphoteric polymer.

Furthermore, the use of a mineral coagulant of type X1 (X1/B1 vs B1, or X1/C1/B1 vs C1/B1) does not offer any improvement in terms of retention, filler retention or dewatering performances, which clearly differentiates this invention from the BASF prior art (U.S. Pat. No. 8,926,797).

Example 4: Variation of the Nature of the Amphoteric Polymer on the Retention, Filler Retention and Dewatering Under Vacuum Performances (on a Virgin Fiber Pulp)

TABLE 4

Properties obtained in the presence (invention and counter-examples) or not (blank) of a cationic product and an amphoteric product.

| Products | Dosage (kg/t) | FPR (%) | FPAR (%) | DDA (s) | |
|---|---|---|---|---|---|
| Blank | 0 | 72.0 | 4.9 | 34.7 | CE |
| C1 | 0.5 | 78.1 | 29.7 | 25.5 | |
| C1 | 0.5 | 87.5 | 63.2 | 16.2 | |
| B1 | 0.5 | | | | |
| C1 | 0.5 | 86.7 | 61.2 | 16.3 | |
| B2 | 0.5 | | | | |
| C1 | 0.5 | 85.3 | 56.3 | 16.4 | |

TABLE 4-continued

Properties obtained in the presence (invention and counter-examples) or not (blank) of a cationic product and an amphoteric product.

| Products | Dosage (kg/t) | FPR (%) | FPAR (%) | DDA (s) | |
|---|---|---|---|---|---|
| B3 | 0.5 | | | | |
| C1 | 0.5 | 86.6 | 61.0 | 16.2 | |
| B4 | 0.5 | | | | |
| C1 | 0.5 | 78.9 | 31.1 | 24.1 | CE |
| Z1 | 0.5 | | | | |
| C1 | 0.5 | 78.2 | 30.3 | 26.5 | CE |
| Z2 | 0.5 | | | | |

CE: counter-example, combination non-compliant with the method of the invention.
The "blank" corresponds to a test without additive.

It clearly appears in Table 4 that the amphoteric products obtained by gel polymerization, suspension polymerization, inverse emulsion polymerization or dispersion polymerization are of real interest in terms of simultaneous retention, filler retention and dewatering performances vis-à-vis the amphoteric products obtained by solution polymerization used in the prior art.

Indeed, by referring to products Z1 and Z2 (respectively the amphoteric products shown in prior art documents U.S. Pat. No. 8,926,797 and US 2011/0155339) in Table 4, this invention shows improvements, in terms of performance, in the order of 9 points for retention, 35 points for filler retention and 9 seconds for dewatering under vacuum.

Example 5: Comparison of the Method of the Invention/Prior Art Methods on Dewatering Under Vacuum Performances (on a Virgin Fiber Pulp

TABLE 5

Properties obtained according to the invention or according to the prior art

| Products | Dosages (kg/t) | FPR (%) | FPAR (%) | DDA (s) | |
|---|---|---|---|---|---|
| Blank | 0 | 72.0 | 4.9 | 36.8 | CE |
| C1 | 0.5 | 87.5 | 63.2 | 15.6 | |
| B1 | 0.5 | | | | |
| C2 | 0.5 | 87.9 | 62.8 | 16.9 | |
| B1 | 0.5 | | | | |
| C3 | 0.5 | 88.5 | 64.8 | 13.8 | |
| B1 | 0.5 | | | | |
| C4 | 0.5 | 86.5 | 61.8 | 17.1 | |
| B1 | 0.5 | | | | |
| X2 | 5 | 79.5 | 32.8 | 22.2 | AA1 |
| C2 | 0.5 | | | | |
| Z1 | 0.5 | | | | |
| X2 | 5 | 78.9 | 31.1 | 25.6 | AA1 |
| C1 | 0.5 | | | | |
| Z1 | 0.5 | | | | |
| X2 | 5 | 78.1 | 30.5 | 22.5 | AA1 |
| C4 | 0.5 | | | | |
| Z1 | 0.5 | | | | |
| C1 | 0.5 | 78.2 | 30.3 | 27.5 | AA2 |
| Z2 | 0.5 | | | | |
| C3 | 0.5 | 78.9 | 31.2 | 26.5 | AA2 |
| Z2 | 0.5 | | | | |

AA1: described in document U.S. Pat. No. 8,926,797.
AA2: described in document US 2011/0155339.
The "blank" corresponds to a test without additive.

In Table 5, it can be clearly seen that the retention, filler retention and dewatering performances delivered by the combination described in the invention are clearly better than those of the prior art.

Example 6: Combination, from the Invention, Between a Cationic Product and an Amphoteric Product (on Recycled Board Fiber Pulp)

TABLE 6

Properties obtained according to the invention or not (blank) from a recycled fiber pulp

| | Dosage (kg/t) | FPR (%) | FPAR (%) | DDA (s) | CSF (ml) | Burst Index | DBL MD | Ash Content (%) |
|---|---|---|---|---|---|---|---|---|
| Blank | 0 | 76.5 | 31.7 | 44.1 | 308 | 1.60 | 2.16 | 6.2 |
| C1 | 0.25 | 80.3 | 37.2 | 31.3 | 327 | 1.67 | 2.17 | 7.8 |
| B1 | 0.25 | | | | | | | |
| C1 | 0.5 | 85.4 | 55.2 | 24 | 362 | 1.68 | 2.20 | 8.5 |
| B1 | 0.5 | | | | | | | |
| C1 | 0.75 | 89.4 | 68.9 | 16.6 | 426 | 1.69 | 2.27 | 9.9 |
| B1 | 0.75 | | | | | | | |
| C1 | 1 | 91.2 | 74.9 | 11.4 | 481 | 1.71 | 2.31 | 10.2 |
| B1 | 1 | | | | | | | |
| C1 | 1.5 | 96.1 | 88.8 | 10.1 | 568 | 1.73 | 2.35 | 10.3 |
| B1 | 1.5 | | | | | | | |

The "blank" corresponds to a test without additive.

According to Table 6, on a recycled board pulp, it is possible, on the one hand, to drastically improve the retention, filler retention and dewatering performances, and on the other hand, to increase the level of filler in the sheet without negatively affecting the mechanical characteristics thereof (burst index and breaking length).

It is also observed that the dewatering performances, whether measured under vacuum or by gravity are in the two most improved cases.

By referring to Example 1 (virgin fiber pulp), it can be concluded that the benefits of this invention are valid regardless of the type of fibers used, and the papers produced.

The invention claimed is:

1. A process for manufacturing a sheet of paper and/or board from a fibrous suspension, the process comprising, before formation of said sheet, adding to the fibrous suspension, at one or more injection points, at least two retention aids respectively:

(a) at least one water-soluble organic cationic polymer P1 with a cationicity greater than 2 $meq \cdot g^{-1}$, and (b) at least one water-soluble amphoteric polymer P2 of at least one anionic monomer and of at least one cationic monomer, wherein the polymer P2 is added to the fibrous suspension after dissolving, in aqueous solution, the polymer P2 previously obtained by one of the following polymerization techniques:

gel polymerization, suspension polymerization, inverse emulsion polymerization, dispersion polymerization, and in that polymer P2 has a factor F>2, said factor F being defined by the formula: $F=UL^2\times[(100-A)/(100-C)]$ with UL: Brookfield viscosity of the polymer P2 at 0.1% by weight in a 1M aqueous solution of NaCl, at 23° C., with a UL module and at 60 $rev \cdot min^{-1}$ A and C corresponding respectively to the molar percentages of the anionic and cationic monomers of the polymer P2.

2. A process according to claim 1, wherein the polymer P1 is introduced into the fibrous suspension at a rate of 100 to 1500 $g \cdot t^{-1}$ of dry paper and/or board.

3. A process according to claim 1, wherein the polymer P2 is introduced into the fibrous suspension at a rate of 100 to 1500 $g \cdot t^{-1}$ of dry paper and/or board.

4. A process according to claim 1, wherein the polymer P1 is selected from:

(i) polyvinylamines and/or (ii) polyethyleneimines, and/or, (iii) polyamines, and/or, (iv) poly(diallyldimethylammonium chloride), and/or, (v) poly(amidoamine-epihalohydrin).

5. A process according to claim 1, wherein the polymer P1 results from the degradation reaction known as Hofmann, in aqueous solution, in the presence of an alkaline earth and/or alkali hydroxide and an alkaline earth and/or alkali hypohalide, on a (co)polymer based on at least:

a non-ionic monomer selected from the group comprising acrylamide, methacrylamide, N,N-dimethylacrylamide, t-butylacrylamide, octylacrylamide, optionally another monomer containing at least one unsaturated bond.

6. A process according to claim 1, wherein the polymer P1 is a fully or partially hydrolyzed N-vinylformamide (co) polymer.

7. A process according to claim 1, wherein the polymer P1 is a polyamine.

8. A process according to claim 1, wherein the polymer P1 is a poly(diallyldimethylammonium chloride).

9. A process according to claim 1, wherein the polymer P1 is a poly(amidoamine-epihalohydrin).

10. A process according to claim 1, wherein the polymer P1 has a cationic charge density greater than 4 $meq \cdot g^{-1}$.

11. A process according to claim 1, wherein the polymer P2 is a polymer of:

a/ at least one cationic monomer selected from the group comprising dimethylaminoethyl acrylate (ADAME) quaternized or salified, and/or dimethylaminoethyl methacrylate (MADAME) quaternized or salified, and/or dimethyldiallylammonium chloride (DADMAC), and/or acrylamido propyltrimethyl ammonium chloride (APTAC) and/or methacrylamido propyltrimethyl ammonium chloride (MAPTAC), and/or fully or partially hydrolyzed N-vinyl formamide, b/ at least one anionic monomer having at least one carboxylic, and/or sulfonic, and/or phosphoric function, c/ and/or at least one monomer of a non-ionic nature, d/ optionally at least one monomer with a zwitterionic nature, e/ optionally at least one monomer with a hydrophobic nature, f/ optionally at least one monomer containing at least two unsaturated bonds.

12. A process according to claim 1, wherein the polymer P2 has a Brookfield viscosity greater than 2 cps.

13. A process according to claim 1, wherein the mass ratio between the polymer P1 and the polymer P2 is between 1/10 and 10/1.

14. A process according to claim 1, wherein a tertiary anionic retention aid selected from the organic polymers and/or inorganic microparticles is added to the fibrous suspension.

15. A process according to claim 14, wherein the tertiary anionic retention aid is introduced into the fibrous suspension at a rate of 20 to 2500 $g \cdot t^{-1}$ of dry paper and/or board.

16. A process according to claim 1, wherein the polymer P1 and the polymer P2 are independently introduced into the fibrous suspension at a rate of 100 to 1500 $g \cdot t^{-1}$ of dry paper and/or board.

17. A process according to claim 16, wherein the polymer P1 results from the degradation reaction known as Hofmann, in aqueous solution, in the presence of an alkaline earth and/or alkali hydroxide and an alkaline earth and/or alkali hypo-halide, on a (co)polymer based on at least:

a non-ionic monomer selected from the group comprising acrylamide, methacrylamide, N,N-dimethylacrylamide, t-butylacrylamide, octylacrylamide, optionally another monomer containing at least one unsaturated bond.

18. A process according to claim 16, wherein the polymer P1 is:

a fully or partially hydrolyzed N-vinylformamide (co) polymer;

a polyamine;

a poly(diallyldimethylammonium chloride); or a poly(amidoamine-epihalohydrin).

19. A process according to claim 18, wherein the polymer P1 has a cationic charge density greater than 4 $meq \cdot g^{-1}$.

20. A process according to claim 19, wherein the polymer P2 has a Brookfield viscosity greater than 2 cps, and is a polymer of:

a/ at least one cationic monomer selected from the group comprising dimethylaminoethyl acrylate (ADAME) quaternized or salified, and/or dimethylaminoethyl methacrylate (MADAME) quaternized or salified, and/or dimethyldiallylammonium chloride (DADMAC), and/or acrylamido propyltrimethyl ammonium chloride (APTAC) and/or methacrylamido propyltrimethyl ammonium chloride (MAPTAC), and/or fully or partially hydrolyzed N-vinyl formamide, b/ at least one anionic monomer having at least one carboxylic, and/or sulfonic, and/or phosphoric function, c/ and/or at least one monomer of a non-ionic nature, d/ optionally at least one monomer with a zwitterionic nature, e/ optionally at least one monomer with a hydrophobic nature, f/ optionally at least one monomer containing at least two unsaturated bonds.

* * * * *